United States Patent [19]

Beaton

[11] Patent Number: 4,574,534

[45] Date of Patent: Mar. 11, 1986

[54] TENSION ENCLOSURE SYSTEM

[76] Inventor: Patrick H. Beaton, Box 51 Site 2 R.R. #8, Calgary, Alberta, Canada, T2J 2T9

[21] Appl. No.: 702,334

[22] Filed: Feb. 15, 1985

[30] Foreign Application Priority Data

Feb. 14, 1984 [CA] Canada ..... 447363

[51] Int. Cl.[4] ..... E04B 1/12

[52] U.S. Cl. ..... 52/63; 52/DIG. 12; 411/340; 182/47; 182/129; 24/335; 24/609

[58] Field of Search ..... 52/DIG. 12, 63, 4, 3, 52/173 R; 182/47, 129; 135/119, 120, DIG. 9; 248/63, 74.4; 411/340, 341, 342, 345; 24/326, 327, 335, 102 PL, 97, 609

[56] References Cited

U.S. PATENT DOCUMENTS

| | | | |
|---|---|---|---|
| 3,121,470 | 2/1964 | Stone et al. | 182/129 |
| 3,749,820 | 7/1973 | Langlie et al. | 24/326 |
| 3,762,110 | 10/1973 | Boss, Jr. | 52/63 |
| 3,805,816 | 4/1974 | Nolte | 52/DIG. 12 |

FOREIGN PATENT DOCUMENTS

| | | | |
|---|---|---|---|
| 91256 | 7/1961 | Denmark | 411/345 |
| 2326958 | 12/1974 | Fed. Rep. of Germany | 182/129 |
| 52-31547 | 3/1977 | Japan | 52/DIG. 12 |
| 2062078 | 5/1981 | United Kingdom | 182/129 |

*Primary Examiner*—Henry E. Raduazo
*Assistant Examiner*—John M. White
*Attorney, Agent, or Firm*—George H. Dunsmuir

[57] ABSTRACT

A protective cover for temporarily enclosing a building or other structure during construction, includes a plurality of plastic or canvas panels which are mounted on cables connected to the structure, in parallel spaced apart vertical rows, by connectors including a rod for insertion through grommets in the edges of the panels, a lever rotatably mounted on one end of the rod for rotation around an axis perpendicular to the longitudinal axis of the rod, so that the rod can be inserted through the grommet and rotated to a locked position, and a C-shaped cable clamp on the other end of the rod, the cable clamp including a web mounting on and projecting perpendicular to the rod on each side thereof, an arm on each end of the web extending towards the other end of the rod and a slot in one side of each arm, the slot being inclined towards the other end of the rod and being sufficiently deep that a cable can be inserted through the slots and retained therein by the rod.

4 Claims, 17 Drawing Figures

TENSION ENCLOSURE SYSTEM

BACKGROUND OF THE INVENTION

This invention relates to a connector and to a protective cover and in particular to a connector and a protective cover for temporarily enclosing a building or other structure during construction.

In the past building contractors have been faced with the problem of temporarily protecting workmen, buildings and other structures from the elements. Many covers have been proposed, including those disclosed in U.S. Pat. No. 2,804,951 issued to W. J. Kolt on Sept. 3, 1957; No. 3,121,470 issued to A. W. Stone et al on Feb. 18, 1964; No. 3,798,851 issued to M. Utahara on Mar. 26, 1974; No. 3,805,816 issued to R. B. K. Nolte on Apr. 23, 1974 and No. 3,995,715 issued to U. F. Virtanen on Dec. 7, 1976. In spite of the existence of such patents one of the most common covers currently employed includes wooden frames covered with polyethylene sheets. Many of the patented covers are expensive and their installation is time consuming. Moreover, all too often the effectiveness of temporary covers depends chiefly on the skill of the workmen installing such covers.

The object of the present invention is to overcome at least partially the problems mentioned above, by providing a relatively simple, easily installed and dismantled protective cover for buildings and other structures.

Another object of the invention is to provide a relatively simple, effective connector for use in a protective cover for buildings and other structures.

BRIEF SUMMARY OF THE INVENTION

Accordingly, the present invention relates to a connector for releasably connecting a protective cover to a building or other structure, the cover being formed by cables connected to the structure in parallel, spaced apart vertical rows, panels for stretching between adjacent cables and grommets in the side edges of said panels, said connector comprising rod means for insertion through said grommet means; lever means rotatable on one end of said rod means for rotation around an axis perpendicular to the longitudinal axis of said rod means between a grommet insertion position in which the rod means and lever means are substantially aligned, and a locked position in which the rod means and lever means are at right angles to each other; and substantially C-shaped cable clamp means on the other end of said rod means, said cable clamp means including web means mounted on and projecting perpendicular to said rod means on each side thereof, arm means on each end of said web means extending towards said other end of said rod means, and slot means in one side of each said arm means, said slot means being inclined towards said other end of said rod means and being sufficiently deep that one said cable means can be inserted through said slot means and retained therein by said rod means.

The invention also relates to a protective cover for a building or other structure, comprising cable means for connection to said structure in spaced apart vertical rows; panel means for stretching between adjacent cable means; grommet means in the side edges of said panel means; and a connector of the type described above for interconnecting adjacent overlapping panel means and for connecting the panel means to the cable means.

BRIEF DESCRIPTION OF THE DRAWINGS

The invention will now be described in greater detail with reference to the accompanying drawings which illustrate a preferred embodiment of the invention and wherein.

DESCRIPTION OF THE PREFERRED EMBODIMENT(S)

Figure 1:
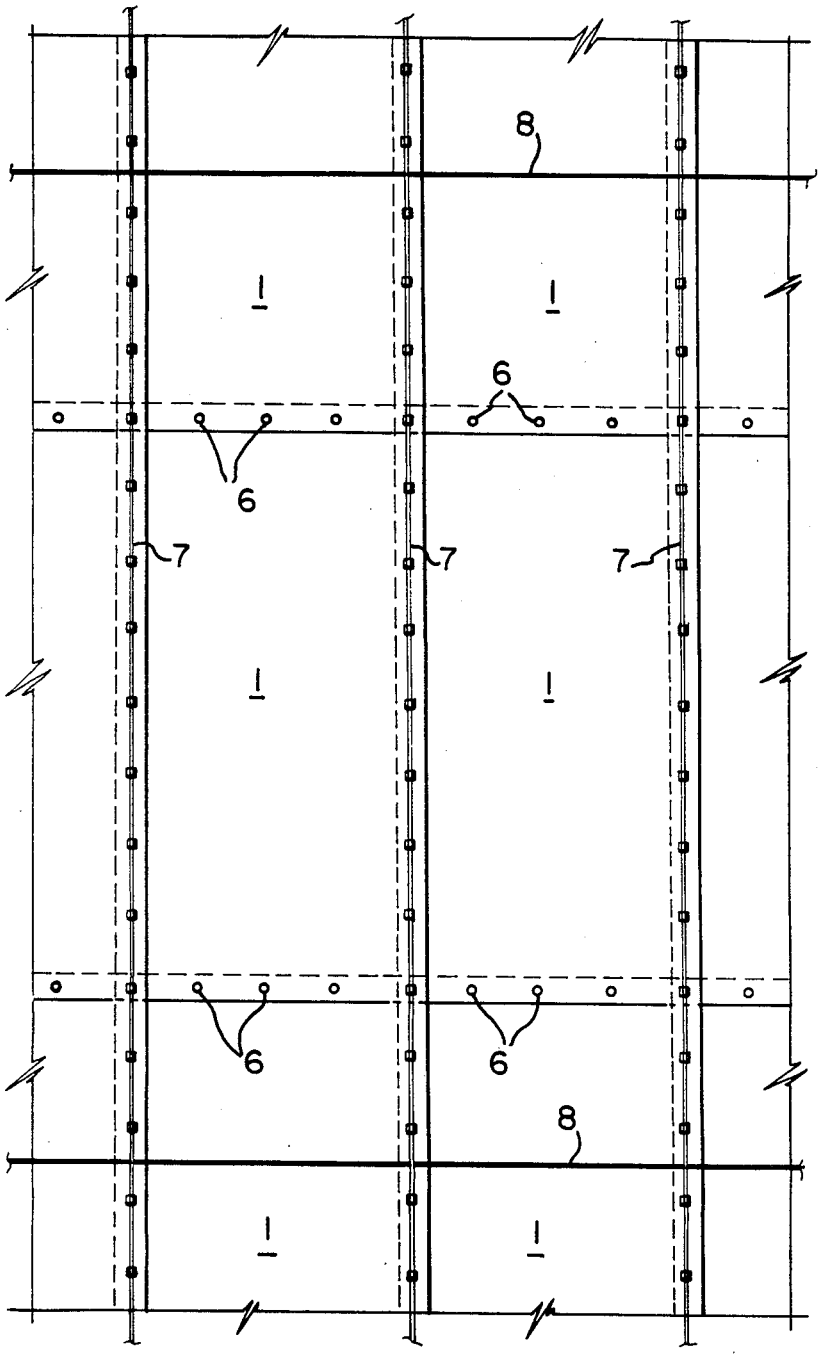
FIG. 1 is a schematic front elevation view of a protective cover in accordance with the present invention.

With reference to FIG. 1, the cover of the present invention includes a plurality of flexible panels 1, e.g. canvas or re-inforced plastic. The panels 1 are mounted on a partially completed building or other structure (not shown) during construction or protect workmen and the structure itself from the elements. A strip 2 of material (FIGS. 10 to 13) is connected to one vertical and one horizontal side of each panel 1, forming a pocker 3 for receiving the edge 4 of an adjacent panel 1. A plurality of holes with grommets 6 are provided along the edges of the panels 1 and in the strips 2 for interconnecting the panels and for connecting the panels 1 to cables 7. The cables 7 are arranged in parallel, vertical rows for tying the panels 1 to the structure. The ends (not shown) of the cables 7 are connected to the structure for retaining the panels 1 on the structure. The usual horizontal safety cables 8 are provided on each floor of the structure and such cables 8 (FIG. 1) are threaded between the cables 7 and the panels, to retain the panels against the structure.

Figure 2:
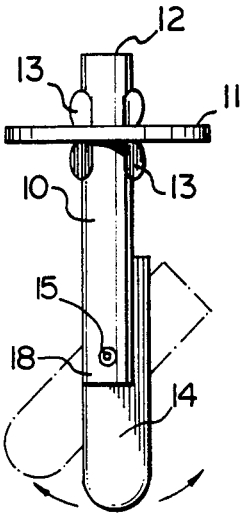
FIG. 2 is a side elevation view of one form of connector for use with the cover of the present invention.
Figure 4:
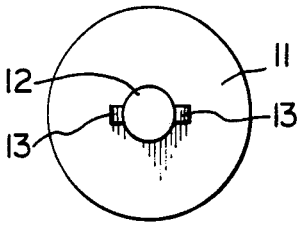
FIG. 4 is an end view of the connector of FIGS. 1 and 2.
Figure 3:
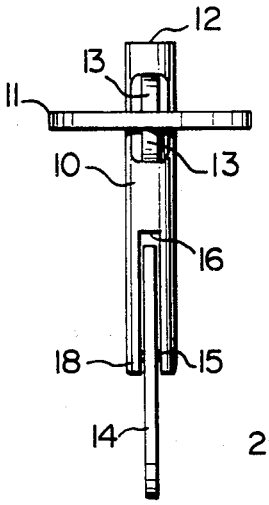
FIG. 3 is a plan view of the connector of FIG. 2.

As shown in FIGS. 2 to 4 one form of connector for interconnecting adjacent panels includes an elongated body or rod 10. A washer 11 is mounted on one end 12 of the rod 10. The washer 11 is retained on the rod 10 by small wings 13 formed by deforming portions of the rod 10 on each side of the washer 11. A lever 14 is pivotally mounted on a pin 15 in a slot 16 in the other end 18 of the rod 10.

A connector (FIGS. 5 to 7) for interconnecting adjacent panels 1, and for connecting the panels to a cable 7 includes a rod 10 and a lever 14 which are identical to the rod 10 and lever 14 of the connector of FIGS. 2 to 4. Instead of a washer a generally C-shaped cable clamp 20 is provided near the end 12 of the rod 10. The clamp 20 is defined by a rectangular web of material 21 mounted on the rod 10 and a pair of arms 22 integral with the web 21 and extending outwardly therefore towards the end 12 of the rod 10. A slot 24 is provided in each arm 22 of the clamp 20. The slot 24 is inclined toward the end 12 of the rod 10, i.e., the inner closed end 25 of each slot 24 is closer to the end 12 than the open end 26 of the slot.

Figure 8:
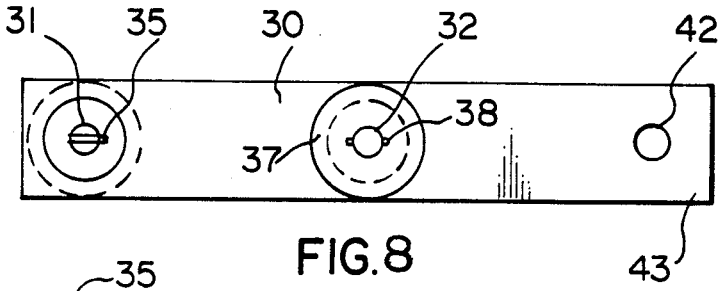
FIG. 8 is a side elevation view of another form of connector used with the cover of the present invention.
Figure 9:
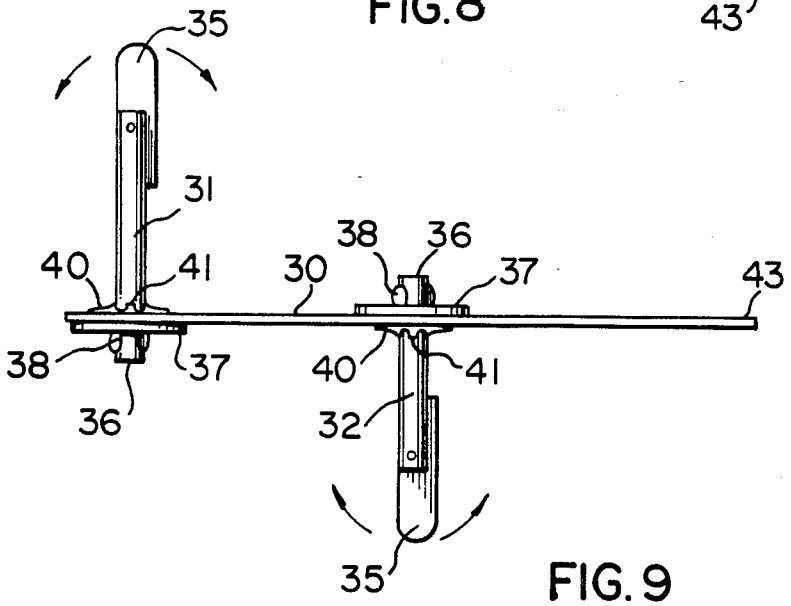
FIG. 9 is a plan view of the connector of FIG. 8.

Referring to FIGS. 8 and 9, another connector for use with the cover of the present invention includes a rectangular strip 30 of fabric re-inforced rubber or another strong, flexible material. A pair of rods 31 and 32 are mounted in the strip 30. One rod 31 is at one end projecting outwardly from one side of the strip and the second rod 32 is at the centre of the strip 30 projecting outwardly from the opposite side of the strip. A lever 35 pivotally mounted in the slot at the outer free end of each rod 31 and 32. The other end 36 of each rod is securely connected to the strip 30 by a washer 37 and wings 38 on one side of the strip and by spring washers 40 on the other side of the strip 30. The washers 40 are slightly domed with a crenellated inner edge 41 for gripping the rod 31 or 32. An opening 42 is provided in the end 43 of the strip 30 opposite to the rod 31 for receiving the latter.

Figure 10:
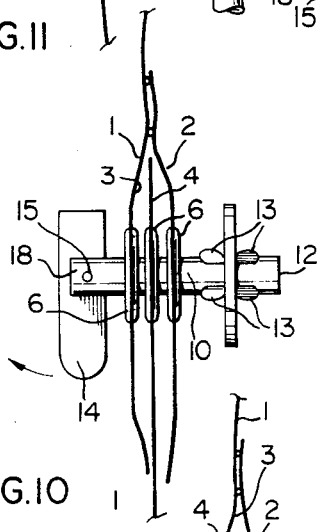
FIG. 10 is a side elevation view of the connector of FIGS. 2 to 4 in use.

As shown in FIG. 10 the connector of FIGS. 2 to 4 is used to interconnect adjacent panels 1. The lever end 18 of the rod 10 is inserted through the grommets 6 and the lever 14 is turned from an open position (FIG. 2) aligned with the longitudinal axis of the rod 10 to the closed position (FIG. 10) perpendicular to the longitudinal axis of rod 10.

Figure 5:
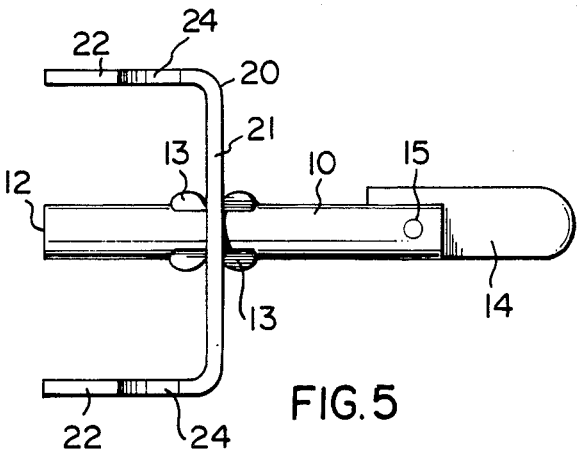
FIG. 5 is a side elevation view of another form of connector for use in the cover of the present invention.
Figure 6:
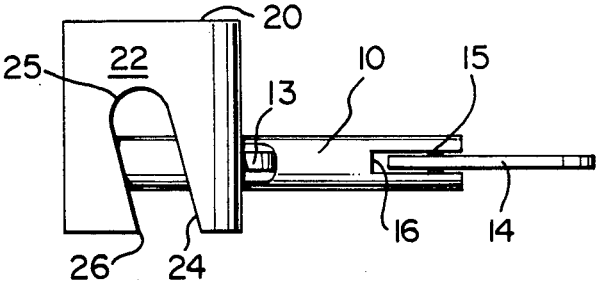
FIG. 6 is a plan view of the connector of FIG. 5.
Figure 7:
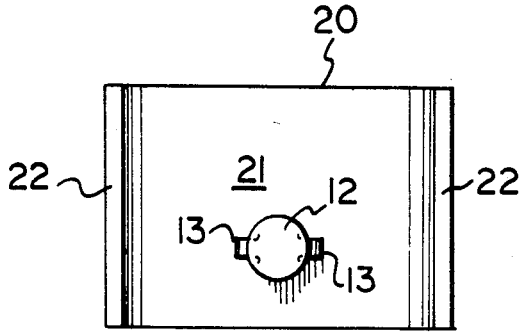
FIG. 7 is an end view of the connector of FIGS. 5 and 6.
Figure 11:
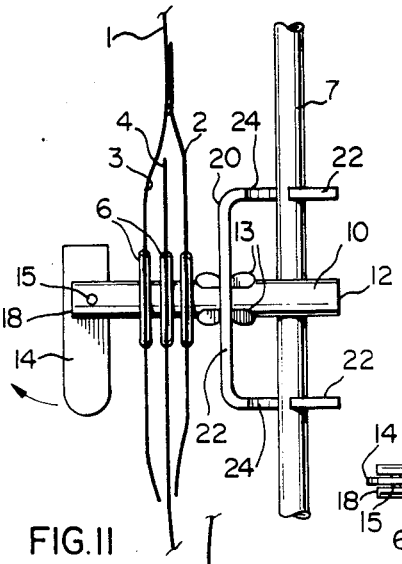
FIG. 11 is a side elevation view of the connector of FIGS. 5 to 7 in use.
Figure 12:
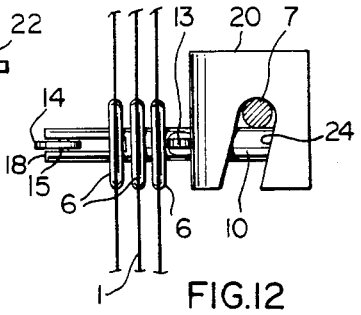
FIG. 12 is a plan view of the connector of FIGS. 5 to 7 in use.

Referring to FIGS. 11 and 12 the connector of FIGS. 5 to 7 is used to connect adjacent panels 1 and 2 to each other and to a cable 7. The connection between the panels 1 and 2 and the lever end 18 of the rod 10 is the same as with the connector of FIGS. 2 to 4. The cable 7 is threaded through the clamp 20 so that the cable is jammed between the closed end 25 of the slots 24 and the end 12 of the rod 10.

Figure 13:
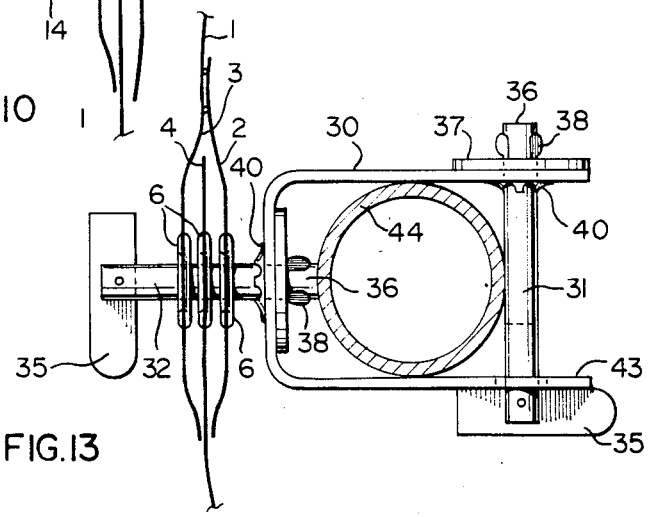
FIG. 13 is a plan view of another form of connector for use with the cover of FIG. 1.
Figure 14:
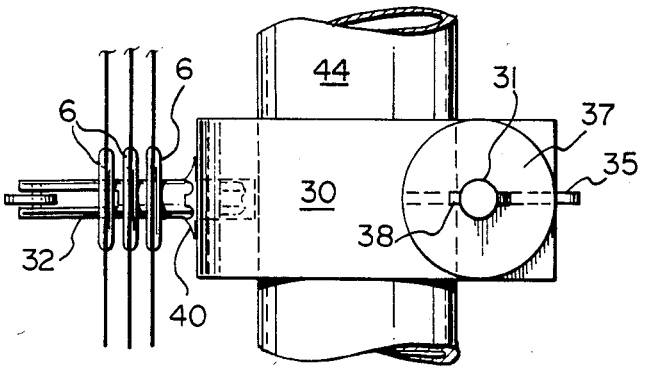
FIG. 14 is a side elevation view of the connector of FIG. 13.

The connector of FIGS. 8 and 9 is used by inserting the rod 32 through aligned grommets 6 to connect overlapping panels 1 together. The strip 30 is wrapped around a scaffolding tube 44 or the like, the lever end of the rod 31 is inserted through the opening 42 and the lever 35 is rotated to the closed position (FIGS. 13 and 14).

Figure 15:
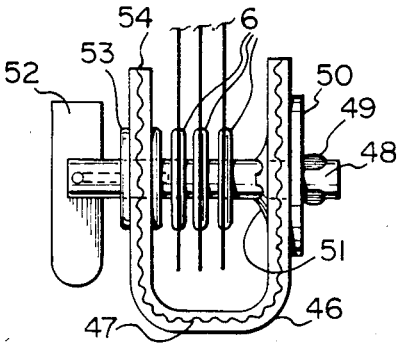
FIG. 15 is a plan view of another connector in accordance with the present invention.
Figure 16:
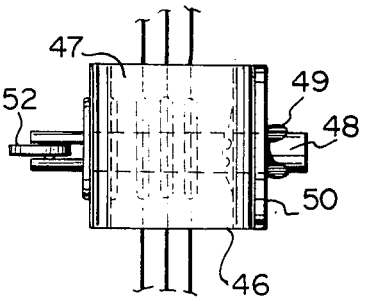
FIG. 16 is an elevation view of the connector of FIG. 15.

Another embodiment of the connector 46 is shown in FIGS. 15 and 16. The connector 46 is used to connect the panels 1 to a safety cable 8 (FIG. 1) and includes a strip 47 of re-inforced rubber, with a single rod 48 connected to one end thereof by wings 49, a washer 50 and a lock washer 51. A lever 52 is provided on the other end of the rod 48. The lever end of the rod 48 is inserted through grommets 6 on panels 1, the strip 47 is folded around the cable 8 (not shown in FIGS. 15 and 16) and the lever end of the rod is inserted through a grommet 53 in the free end 54 of the strip 47. The lever 52 is rotated to the closed position (FIG. 15) to lock the ends of the strip 47 together.

Figure 17:
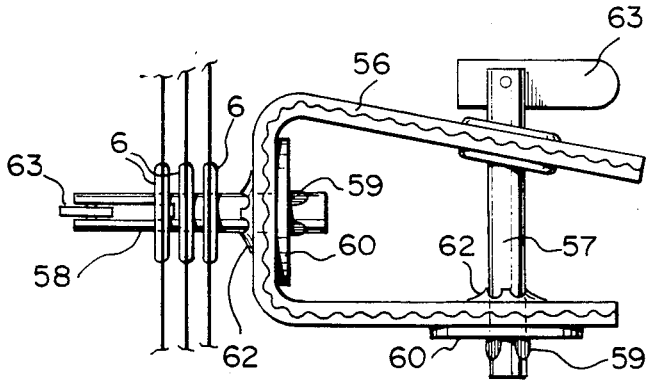
FIG. 17 is a plan view of yet another form of connector in accordance with the present invention.

The connector of FIG. 17 is similar to the connector of FIGS. 8 and 9, including a strip 56 of re-inforced rubber or the like, and a pair of rods 57 and 58. The rods 57 and 58 are connected to one end and the centre of the strip 56 for connecting the connector to the panels 1 and for forming a loop for connecting the panels to scaffolding or the like (not shown). Both of the rods 57 and 58 are connected to the strip 56 by wings 59, washers 60 and lock washers 62. Levers 63 on the free ends of the rods 57 and 58 are rotatable between the open and closed positions.

What I claim is:

1. A connector for releasably connecting a protective cover to a building or other structure, the cover being formed by cables connected to the structure in parallel spaced apart vertical rows, panels for stretching between adjacent cables and grommets in the side edges of said panels, said connector comprising rod means for insertion through said grommet means; lever means rotatable on one end of said rod means for rotation around an axis perpendicular to the longitudinal axis of said rod means between a grommet insertion position in which the rod means and lever means are substantially aligned, and a locked position in which the rod means and lever means are at a right angle to each other; and substantially C-shaped cable clamp means on the other end of said rod means, said cable clamp means including web means mounted in and projecting perpendicular to said rod means on each side thereof, arm means on each end of said web means extending towards said other end of said rod means, and slot means in one side of each said arm means, said slot means being inclined towards said other end of said rod means and being sufficiently deep that one said cable means can be inserted through said slot means and retained therein by said rod means.

2. A protective cover for a building or other structure comprising cable means for connection to said structure in spaced apart vertical rows; panel means for stretching between adjacent cable means; grommet means in the side edges of said panel means; first connector means for releasably connecting said panel means to each other and to said cable means, said first connector means including rod means for insertion through said grommet means; lever means rotatable on one end of said rod means for rotation around an axis perpendicular to the longitudinal axis of said rod means between a grommet insertion position in which the rod means and lever means substantially are aligned, and a locked position in which the rod means and lever means are at right angles to each other and substantially C-shaped cable clamp means on the other end of said rod means, said cable clamp means including web means mounted on and projecting perpendicular to said rod means on each side thereof, arm means on each end of said web means extending toward said other end of said rod means and slot means in one side of each said arm means, said slot means being inclined toward said other end of said rod means and being sufficiently deep that one said cable means can be inserted through said slot means and retained therein by said rod means.

3. A protective cover according to claim 1, including grommet means in each edge of said panel means; and second connector means for interconnecting overlapping edges of said panel means, said second connector means including rod means for insertion through aligned grommet means in said overlapping edges; lever means rotatable on one end of said rod means for rotation around an axis perpendicular to the longitudinal axis of said rod means between a grommet insertion position in which the rod means and lever means are substantially aligned, and a locked position in which the rod means and lever means are at a right angle to each other; and washer means on the other end of said rod means.

4. A protective cover according to claim 2 including third connector means for connecting said panel means to scaffolding or the like, said third connector means including strip means; first rod means on one end of said strip means extending outwardly from one side thereof for insertion through an opening in the other end of said strip means for forming a loop; second rod means mounted substantially at the centre of said strip means and extending outwardly from the other side thereof; and lever means rotatably mounted on the outer free end of each said first and second rod means for rotation around an axis perpendicular to the longitudinal axis of said rod means between an insertion position in which the rod means and lever means are substantially aligned and a locked position in which the rod means and lever means are at a right angle to each other.

* * * * *